US005862520A

United States Patent [19]

Wyant

[11] Patent Number: 5,862,520

[45] Date of Patent: Jan. 26, 1999

[54] HAT BRIM

[76] Inventor: Ronald D. Wyant, P. O. Box 1025, Columbia, La. 71418

[21] Appl. No.: 906,230

[22] Filed: Aug. 4, 1997

[51] Int. Cl.[6] ..... A42B 1/06

[52] U.S. Cl. ..... 2/10; 2/175.1; 2/209.13

[58] Field of Search ..... 2/10, 175.1, 209.12, 2/175.5, 209.13

[56] References Cited

U.S. PATENT DOCUMENTS

D. 337,645 7/1993 Guziejka .
D. 340,796 11/1993 Oates .
5,121,507 6/1992 Brown .
5,448,778 9/1995 Phillips .
5,548,846 8/1996 Bianchetti ..... 2/10
5,727,250 3/1998 Black ..... 2/10

*Primary Examiner*—Diana L. Biefeld
*Attorney, Agent, or Firm*—Robert N. Montgomery

[57] ABSTRACT

A hat brim for attaching to a sports cap and the like having a semiflexible, formable stiffener, enclosed in a covering. The stiffener including a central opening and collar having slots for threadably passing the adjustable headband of a sports cap. The covering provided with a pocket for receiving the bill portion of a sports cap thereby converting the sports cap to a wide brim hat.

10 Claims, 3 Drawing Sheets

HAT BRIM

BACKGROUND OF THE INVENTION

1. Field of the Invention

This invention relates generally to head wear and more particular to the adaptation of a wide brim to a sports cap.

2. General Background

Sports caps are generally constructed with a soft head covering portion and semiflexible bill extending outwardly from the wearer's brow to shield the wearer from bright light on the eyes. Such caps usually have some means of headband adjustment to allow for snug fit. Sports caps often reflect the sport or endeavor the wearer participates in, is associated with or favors, by its colors or embroidered emblems emblazoned on the cap. Most wearers have a number of such caps which they favor highly and wear to meet specific occasions. Such caps, while being very efficient in their intended purpose, were not intended to protect the wearer from sunburn about the ears and neck area or allow for air circulation around the neck and head. Therefore, wide brim hats are preferred for such purposes. However, wide brim hats are generally more expensive, bulky, have a tendency to lose their shape and do not, as a rule, represent the often wide interests of the wearer. A great many sports caps have been disclosed which provide a shield attached to the rear portion of a sports cap for covering the wearer's neck as is demonstrated in U.S. Pat. Nos. 5,121,507, 5,448,778, and design patents 340,796 and 337,645. Such cap attachments block the sun but also block any breezes as well, thereby increasing head temperature.

Ideally the wearer needs flexibility to convert a special interest cap to a wide brim hat at will and as the situation requires. For example, a cap can be worn to an event and then converted to a wide brim hat when the wearer is subjected to bright sun light and then removed when in more shaded conditions. An attempt has been made to provide a cap which is convertible to a wide brim hat as disclosed by U.S. Pat. No. 5,548,846. However, this disclosure does not provide for interchangeability of sports caps with a wide brim and requires the wide brim to be folded and concealed within the cap, thereby making the cap hot and heavy.

SUMMARY OF THE INVENTION

The present invention provides a simplistic approach to the problems discussed above. A special configured, relatively stiff, hat brim is provided with a cloth covering. The brim is further configured with a central opening for receiving and attaching to most sports caps by simply threading their adjustable headband through a portion of the brim's collar or band and tucking the cap's bill into pocket provided in the covering above the stiffener. Therefore, virtually any sports cap may be converted to a wide brim hat in seconds. Further, the cloth covering may be provided in any color and be decorated with emblems as desired by the wearer.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
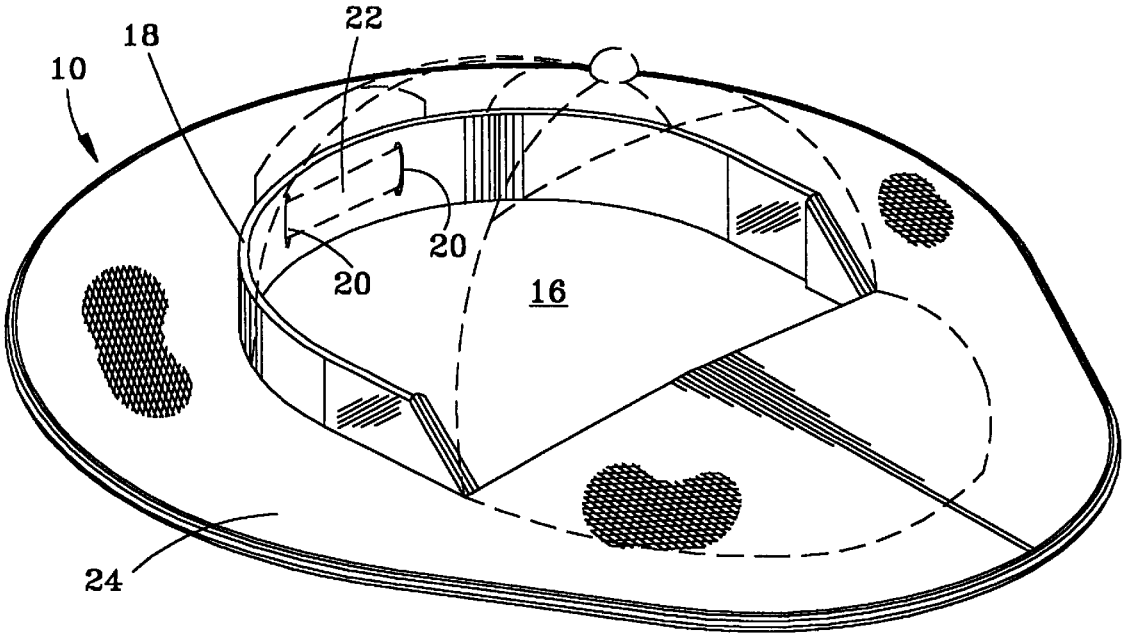
FIG. 1 is a front isometric view of the hat brim illustrating a cap adaptation.
Figure 2:
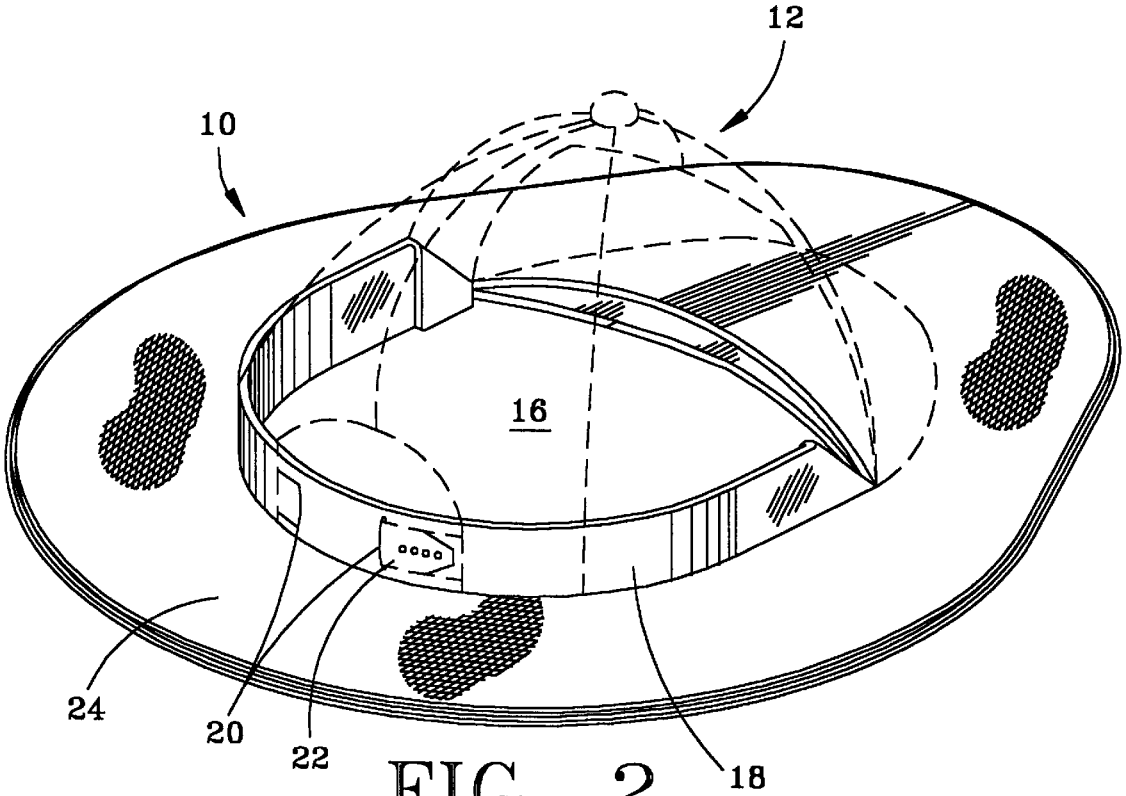
FIG. 2 is a rear isometric view of the hat brim illustrating a cap adaptation.
Figure 3:
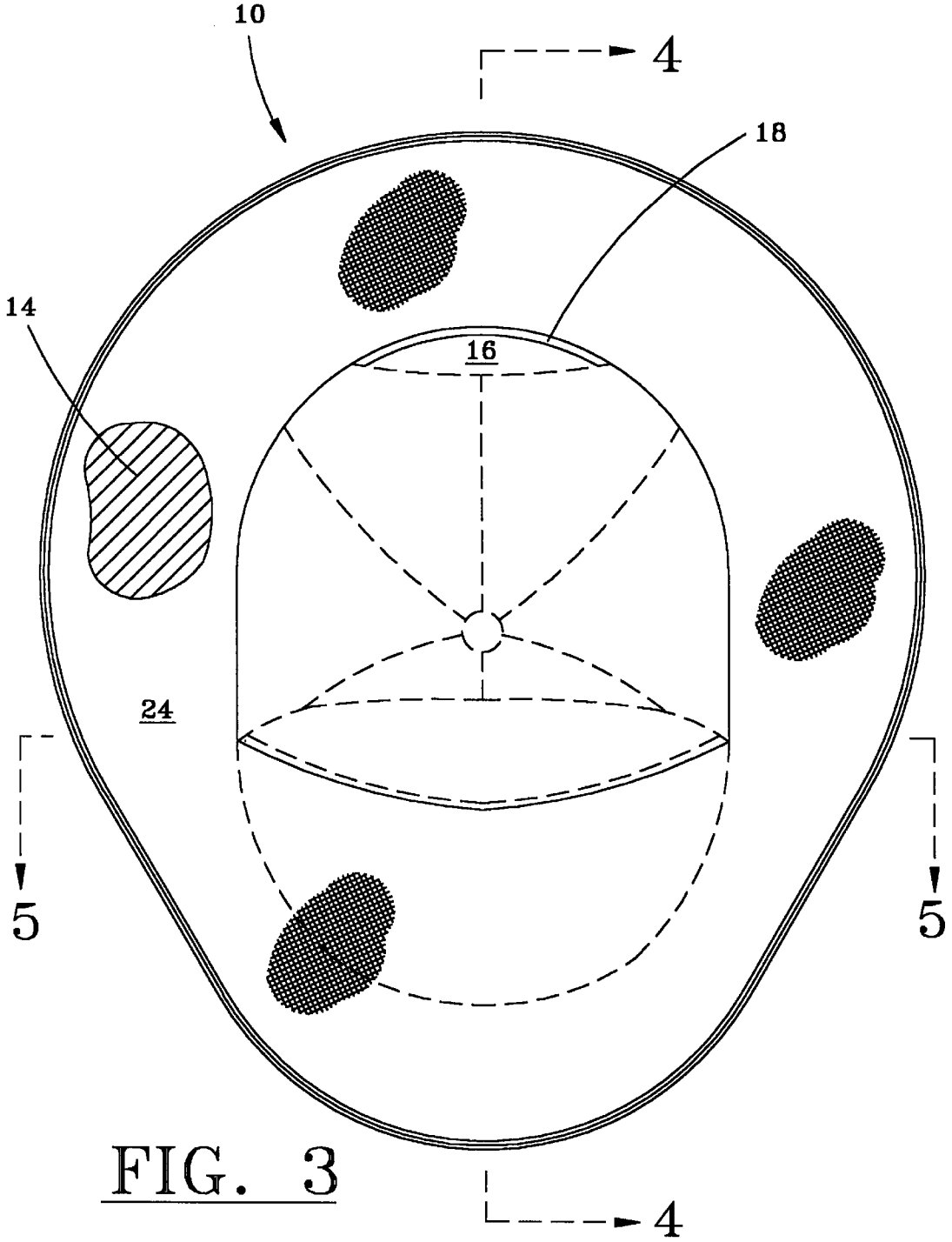
FIG. 3 is a top view if the brim illustrating a cap adaptation.
Figure 4:
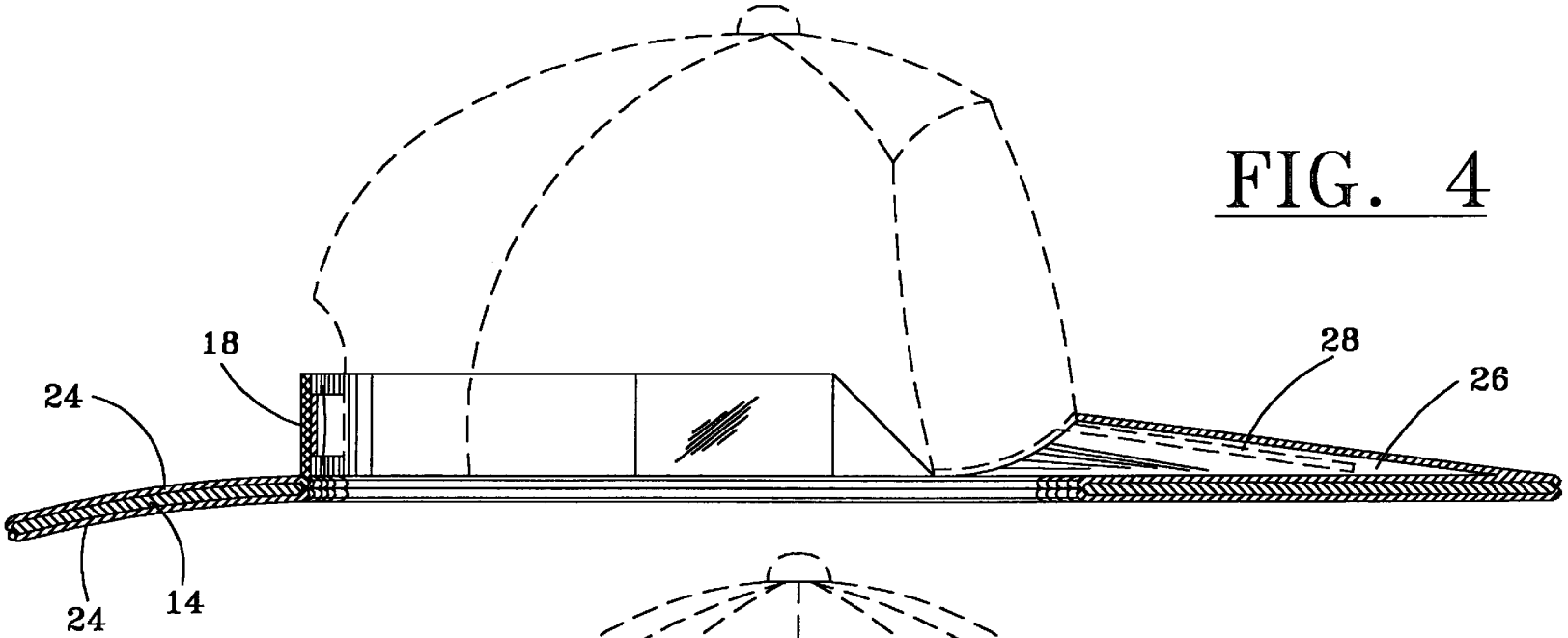
FIG. 4 is a cross section view taken along sight lines 4—4 in FIG. 3.
Figure 5:
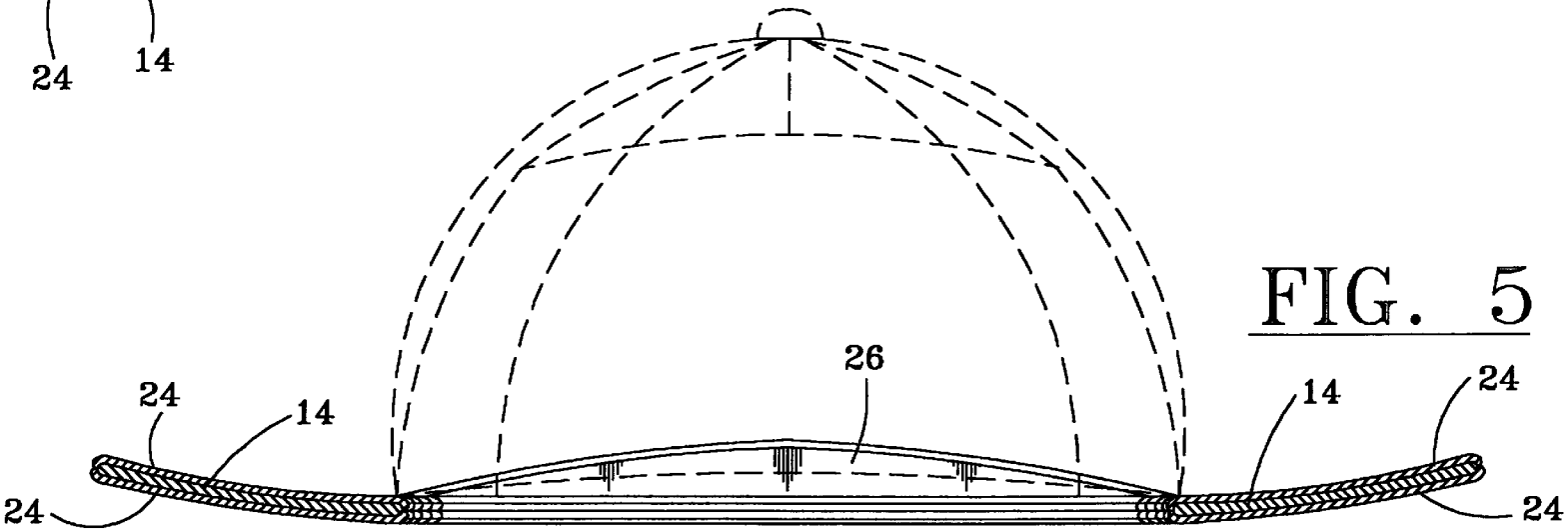
FIG. 5 is a cross section view taken along sight line 5—5 in FIG. 3.

As seen in FIG. 1 a wide hat brim 10 is provided for temporally attaching to a sports cap 12 shown in phantom in all figures. The brim 10 may be configured in unique shapes such as the pear shape illustrated in FIGS. 1–3 and constructed from a flexible stiffener material 14, first seen in FIG. 3 which is formable and thereby capable of holding a shape if curled or sloped as shown in FIGS. 4 and 5. The stiffener 14 is configured with a central cutout 16 which essentially conforms to the headband of a sports cap 12. A portion of the stiffener cutout or opening 16 is surrounded by a band or collar 18. The collar 18 also serves as a stiffener and is provided with slits 20 for threadably attaching the headband adjustment strap 22 of a sports cap 12, as seen in FIGS. 1 and 2.

A cloth covering 24 is provided in the form of a sleeve for enclosing the stiffener 14 and providing a pocket 26 for inserting the bill portion of a sports cap 12 as shown in FIG. 4. The pocket 26 located forwardly of the collar 18 is sufficient to allow insertion of the bill 28 of most sports caps 12. The cloth covering 24 is also configured to the shape of the stiffener 14, including a corresponding central cutout conforming to the stiffener cutout 16. The cloth covering 24 maybe stitched or otherwise attached to the stiffener 14. However, it is foreseen that an elastic type material may be used for the covering 24 which may be removed from the stiffener 14 for cleaning or sewing purposes.

To utilize the brim 10 with a sports cap 12 the wearer simply threads the adjustable headband portion 22 of a sports cap 12 through the slots 20 of the brim collar and reconnects the headband 22 and tucks the sports cap bill 28 into the brim pocket 26.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A hat brim for docking with sports caps having adjustable headbands and bill portions the brim comprising:

a) a flexible stiffener having a central aperture consistent with said sports cap headbands;

b) a collar having slits, said collar being attached to a peripheral portion of said central aperture;

c) a sleeve covering conforming to the configuration of said flexible stiffener; and d) a pocket means defined within said sleeve covering located opposite said collar for receiving the bill portion of a sports cap.

2. The hat brim according to claim 1 wherein said brim is pear shaped having large and small ends.

3. A hat brim according to claim 2 wherein said pocket means is located at said small end.

4. The hat brim according to claim 1 wherein said flexible stiffener is a material capable of generally holding a preset shape.

5. A hat brim according to claim 1 wherein said covering is attached to said flexible stiffener.

6. A hat brim according to claim 1 wherein said covering is a cloth material.

7. A hat brim for docking with sports caps having adjustable headbands and bill portions the brim comprising:

a) a pear shaped flexible stiffener having large and small ends and a central aperture consistent with said sports cap headbands;

b) a collar having slits, said collar attached to a peripheral portion of said central aperture;

c) a sleeve covering conforming to the configuration of said flexible stiffener and being attached to said flexible stiffener; and d) a pocket means defined within said sleeve covering and located opposite said collar at said small end for receiving the bill portion of a sports cap.

8. The hat brim according to claim 7 wherein said flexible stiffener is a material capable of generally holding a preset shape.

9. A hat brim according to claim 7 wherein said covering is a cloth material.

10. A method for demountably attaching a sports cap having a bill portion and an adjustable headband to a hat brim comprising:

a) providing a sports cap having a bill portion and an adjustable headband;

b) providing a hat brim comprising:

i) a flexible stiffener having a central aperture consistent with a sports cap headband;

ii) a collar having slits , said collar attached to a peripheral portion of said central aperture;

iii) a sleeve covering conforming to the configuration of said flexible stiffener; and iv) a pocket defined within said covering opposite said collar for receiving said bill portion of said sports cap; and c) disconnecting said adjustable headband;

d) threading said adjustable headband through said slits in said collar; and e) inserting said bill portion into said pocket means in a manner whereby said sports cap and said hat brim are wearable.

* * * * *